US005152691A

United States Patent [19]

Moscarello

[11] Patent Number: 5,152,691

[45] Date of Patent: Oct. 6, 1992

[54] SNOWBOARD SIMULATOR BALANCE APPARATUS

[76] Inventor: Bruce P. Moscarello, P.O. Box 1644, Manchester Center, Vt. 05255

[21] Appl. No.: 706,348

[22] Filed: May 28, 1991

[51] Int. Cl.[5] ..... A63B 23/00

[52] U.S. Cl. ..... 434/247; 482/146; 482/71; 482/34

[58] Field of Search ..... 434/247, 253; 482/146, 482/142, 51, 71, 34, 147, 68; 472/127, 90, 91

[56] References Cited

U.S. PATENT DOCUMENTS

| | | | |
|---|---|---|---|
| 3,895,794 | 7/1975 | England | 482/146 |
| 4,601,469 | 7/1986 | Sasser | 482/146 |
| 4,826,159 | 5/1989 | Hersey | 482/146 |
| 4,911,440 | 3/1990 | Hyman et al. | 482/146 |

*Primary Examiner*—Richard J. Apley
*Assistant Examiner*—Glenn E. Richman
*Attorney, Agent, or Firm*—Thomas N. Neiman

[57] ABSTRACT

An apparatus designed to allow the user to simulate the action of a snowboard during dryland training. The apparatus has a cylindrical roller that has tapered or angled surface at the outer portions of the roller. The tapered sections may have slots cut into them which would allow for a stepping effect from one tapered surface to the other. Attached to the lower surface of the receiving board are spacers. These spacers provide stability to the apparatus, while at the same time permitting unconventional radial, lateral and yaw motions to the receiving board and roller. The receiving board is attached to the lower surface of the upper deck by using vertical lifts attached between the receiving board and the upper deck. The receiving board may also include a gripping surface material between the lower surface of the receiving board and the roller. The upper surface or deck of the apparatus has a concave outer edge to provide increased surface contact with the feet of the user. The center of the roller has a large slot cut therein to receive a guide rail connected to the horizontal centerline of the lower surface of the receiving board in order to keep the board center over the roller. The guide rail has adjustable end stops that allow the individual to change the length of the rail. The apparatus may provide an axle located through the centerline of the roller that would permit the attachment of a bearing and wheel at the end of the tapered sections to allow for a tighter turning radius for the apparatus.

7 Claims, 2 Drawing Sheets

SNOWBOARD SIMULATOR BALANCE APPARATUS

BACKGROUND OF THE INVENTION

This invention pertains to a balance apparatus, and in particular to such a balance apparatus that provide an individual the means of shifting his or her weight to maintain balance and, at the same time, provide a range of motions to be experienced in snowboard activities.

There are a whole host of balance devices on the market today. Examples of these devices are the United States Patents issued to Stanley Washburn, Jr. for a Roller Board Device U.S. Pat. No. 2,764,411 on Sep. 25, 1956 and to Barry Mendelson for a Teeter Board Device, U.S. Pat. No. 3,995,852 on Dec. 7, 1976. Both of these devices show units that have a roller base section over which a board is positioned. The individual using these devices will center the board over the roller base and use his or her skills to try to maintain their balance by shifting their weight over the roller.

What is needed, though, is a balance device that provides the individuals with a full range of motion that they can experience in snowboarding, which is to say one where turns can be accomplished during balancing motions.

The difficulties that are inherent in other designed balance devices and should be overcome include the following: they are limited in the range of motions that they can provide; they also have structural limitations which would provide stability problems and limits of motion brought on by the structure of those devices.

Clearly, it is desirable for a balance apparatus to provide a full range of motion similar to snowboarding, while remaining simple and easy to use whether indoor or out. It is the object of this invention to set forth a snowboard simulator balance apparatus which avoids the disadvantages and limitations, above-recited, which occur in previous balance devices.

SUMMARY OF THE INVENTION

Particularly, it is the object of this invention to set a snowboard simulator balance apparatus, for providing unconventional radial, lateral and yaw turning motions to the individual using dryland training, comprising a cylindrical roller; said cylindrical roller having tapered sections; said tapered sections comprising a minimum taper of at least point one degree and a maximum taper of eighty nine point nine degrees from the nearest of said sections; receiving board means; said receiving board means having means for providing proper spacing connected to the lower surface of said receiving board means; said receiving board means further having guide rail means positioned along the horizontal centerline of said lower surface of said receiving board means; said receiving board means further having vertical support means positioned to the upper surface of said receiving board means; and upper deck means.

BRIEF DESCRIPTION OF THE DRAWINGS

Further objects and features of this invention will become more apparent by reference to the following description taken in conjunction with the accompanying figures, in which.

DESCRIPTION OF THE PREFERRED EMBODIMENT

Figure 1:
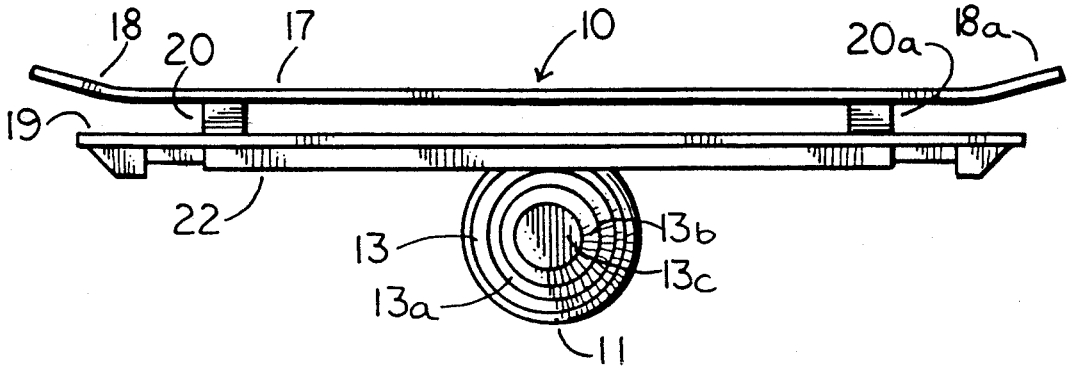
FIG. 1 is a side elevational view of the novel apparatus.
Figure 2:
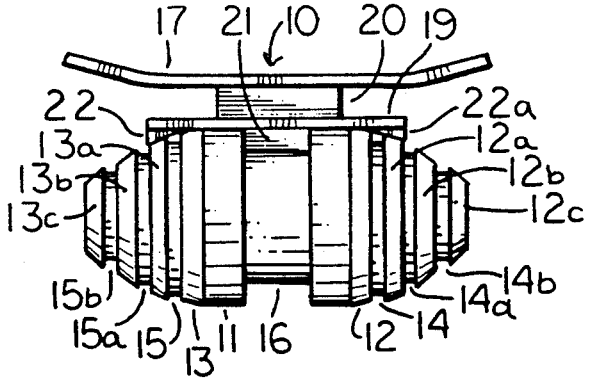
FIG. 2 is a front plan view thereof.
Figure 3:
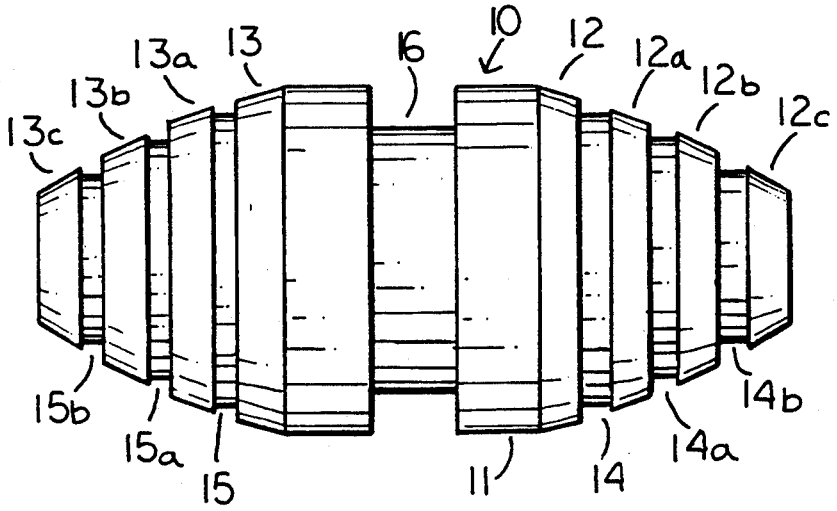
FIG. 3 is an enlarged perspective view of the novel roller.
Figure 4:
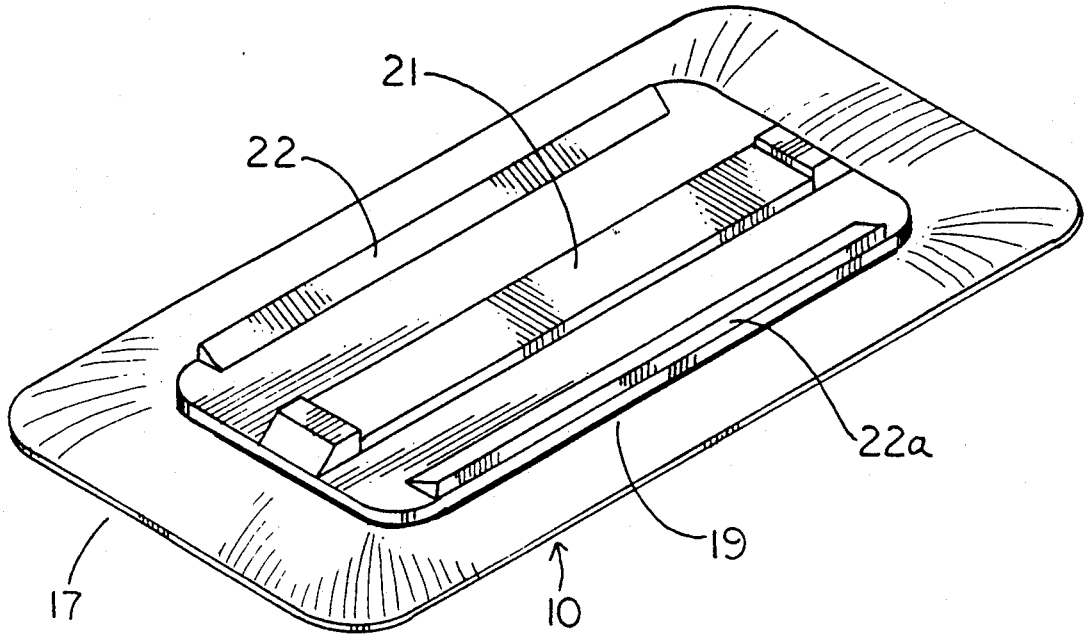
FIG. 4 is a bottom plan view of the lower surface of the receiving board means.
Figure 5:
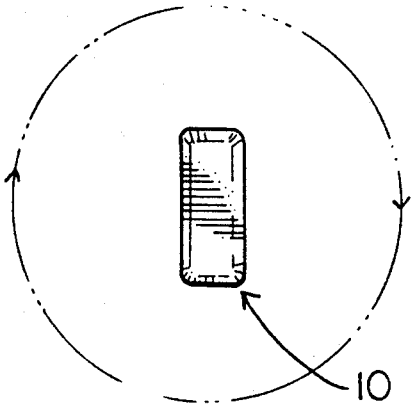
FIG. 5 is a top view of the apparatus showing the full radius turning potential pivoting off of point A.
Figure 6:
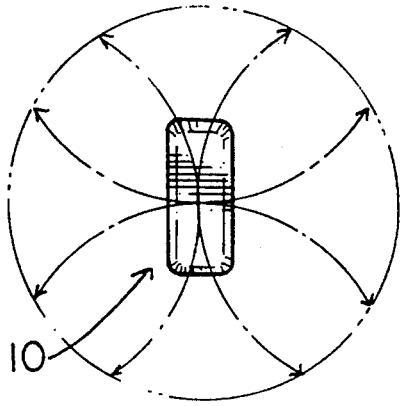
FIG. 6 is a top view of the apparatus showing the unconventional radial turning or yaw.

As shown in the figures, the snowboard simulator balance apparatus 10 is comprised of roller base 11 that comprise a plurality of tapered sections 12 through **12*c* and 13 through 13*c* which may or may not be separated by slots 14 through 14*b* and 15 through 15*b*. The taper from one section to the next can be as little a point one degree or as much as eighty nine point nine degrees. This allows the roller to tip onto a secondary supporting surface while the individual is rolling in a back and forth motion. This creates a large number of varying contact points between the roller and the ground surface. The roller also has a centered guide slot 16**.

The apparatus 10 has an upper deck 17 which has outer section 18, **18*a*, 18*b* and 18*c* bend slightly upward to form a concave shape for the upper deck 17. The concave upper deck provides greater toe and heel contact for the user which creates a quicker response time during the balancing activity. The receiving board 19 is separated from the upper deck 17 by means of lifts 20 and 20*a* that maintain vertical spacing between the upper deck 17 and the receiving board 19. This separation provides a hand hold space for the user during more "wild" motion and allows the upper deck to have more flexibility. The lower surface of the receiving board has a guide rail 21 that fits into the centered guide slot 16 in the roller base 11. This structure allows the roller to remain centered beneath the deck. This guide rail is adjustable to lengthen or shorten the rail as desired for a more or less stable ride. The receiving board 19 also has spacers 22 and 22*a* that are designed to fit onto the tapered surfaces 12 through 12*c* and 13 through 13*c* on the roller base 11. These spacers 22 and 22*a* are designed to minimumize the free play between the roller base 11 and the receiving deck 19** by stabilizing the free motion.

Alternative embodiments of the device can include, but not be limited to having foot restraints positioned in the upper deck. Also, an axle can be made for the roller base which would have a bearing at each and the axle at the opposite ends of the roller deck. Small wheels would be attached at those opposite ends. This design would provide a tighter turning radius for the user. This device may also include a gripping material between the receiving board and the roller to eliminate any slippage. This device may also be completer with a portable riding surface designed to be used on soft ground to support the roller.

While I have described my invention in connection with specific embodiments thereof, it is clearly to be understood that this is done only by way of example and not as a limitation to the scope of my invention as set forth in the objects thereof and in the appended claims.

I claim:

1. A snowboard simulator balance apparatus, for providing unconventional radial, lateral and yaw turning motions to the individual using dryland training, comprising:

a cylindrical roller;

said cylindrical roller having tapered sections;

said tapered sections comprising a minimum taper of at least point one degree and a maximum taper of eighty nine point nine degrees from the nearest of said sections;

receiving board means;

said receiving board means having means for providing proper spacing connected to the lower surface of said receiving board means;

said receiving board means further having guide rail means positioned along the horizontal centerline of said lower surface of said receiving board means;

said receiving board means further having vertical support means positioned from the upper surface of said receiving board; and upper deck means.

2. A snowboard simulator balance apparatus, according to claim 1, wherein:

said cylindrical roller having a guide slot along the vertical centerline of said cylindrical roller;

said cylindrical roller further having an axle means positioned down the horizontal centerline of said cylindrical roller;

said axle means having bearing means at each end of said axle means; and said axle means further having wheel means.

3. A snowboard simulator balance apparatus, according to claim 1, wherein;

said tapered sections have receiving slots cut therein.

4. A snowboard simulator balance apparatus, according to claim 1, wherein:

said means for providing proper spacing comprises strips of angled material for replaceable contact onto said tapered surfaces within said cylindrical roller for providing stability to said apparatus.

5. A snowboard simulator balance apparatus, according to claim 1, wherein:

said guide rail means has means for expanding said guide rail.

6. A snowboard simulator balance apparatus, according to claim 1, wherein:

said vertical support means of said receiving board comprise material lifts for providing space between said upper deck means and said receiving board means.

7. A snowboard simulator balance apparatus, according to claim 1, wherein:

said upper deck means comprise a board; and said board having concave outer sections.

* * * * *